US007086173B1

(12) United States Patent
Alatalo et al.

(10) Patent No.: US 7,086,173 B1
(45) Date of Patent: Aug. 8, 2006

(54) METHOD AND DEVICE FOR CALIBRATING THE POSITION OF BLADES OF A SLITTER-WINDER OF A PAPER OR BOARD MACHINE

(75) Inventors: Jukka Alatalo, Järvenpää (FI); Asko Heikola, Jokela (FI)

(73) Assignee: Metso Paper, Inc., Helsinki (FI)

( * ) Notice: Subject to any disclaimer, the term of this patent is extended or adjusted under 35 U.S.C. 154(b) by 6 days.

(21) Appl. No.: 10/523,758

(22) PCT Filed: Aug. 7, 2003

(86) PCT No.: PCT/FI03/00594

§ 371 (c)(1),
(2), (4) Date: Feb. 8, 2005

(87) PCT Pub. No.: WO2004/014619

PCT Pub. Date: Feb. 19, 2004

(30) Foreign Application Priority Data

Aug. 8, 2002 (FI) ..... 20021454

(51) Int. Cl.
*B27G 13/00* (2006.01)

(52) U.S. Cl. ..... 33/640; 33/628; 83/508.2; 83/425.4; 83/498; 83/499; 83/504

(58) Field of Classification Search ..... 33/613, 33/645, 640, 628, 641, 502; 83/495, 496, 83/497, 498, 499, 500, 501, 502, 503, 504, 83/505, 506, 507, 508.2, 508.3, 425.4
See application file for complete search history.

(56) References Cited

U.S. PATENT DOCUMENTS 319,751 A * 6/1885 Shimer ..... 33/628
493,807 A * 3/1893 Beale ..... 33/628
696,309 A * 3/1902 Bowers ..... 33/628
1,687,649 A * 10/1928 Gillett ..... 33/628
3,205,586 A * 9/1965 Mullen ..... 33/640

(Continued)

FOREIGN PATENT DOCUMENTS

DE 42 33 010 A1 4/1994

(Continued)

OTHER PUBLICATIONS

Search report issued in FI 20021454.

(Continued)

*Primary Examiner*—Diego Gutierrez
*Assistant Examiner*—Travis Reis
(74) *Attorney, Agent, or Firm*—Stiennon & Stiennon

(57) ABSTRACT

A positioning member (21) of a calibration tool (20) touches a slitting edge (17) of one of the blades (11, 12) to be calibrated of a slitter-winder of a paper or board machine. The tool (20) position is measured by the multipoint measurement method and edge position is determined based on the measurement result of the position of the calibration tool (20). A device for calibrating blade position is disposed in connection with the slitter-winder which comprises a top blade (12) and a bottom blade (11), attached to respective blade carriages (11A,12A) which are movable along a guide (14,13). The calibration tool (20) is arranged to be attached to the same guide (14) with the blade (11) to be calibrated. The calibration tool (20) has a means (21) for indicating the slitting edge (17) of the blade (11) and means (23,16) for measuring the position of the calibration tool (20).

16 Claims, 2 Drawing Sheets

U.S. PATENT DOCUMENTS

| | | | | | |
|---|---|---|---|---|---|
| 3,298,106 | A | * | 1/1967 | Duvall | 33/628 |
| 4,443,950 | A | * | 4/1984 | Cockeram | 33/628 |
| 4,458,514 | A | * | 7/1984 | Bathory | 33/613 |
| 4,501,177 | A | * | 2/1985 | Logan et al. | 83/503 |
| 4,531,328 | A | * | 7/1985 | Jewett | 33/628 |
| 4,548,105 | A | | 10/1985 | Koutonen | |
| 4,592,259 | A | | 6/1986 | Görner et al. | |
| 4,607,552 | A | | 8/1986 | Siler | |
| 4,809,573 | A | * | 3/1989 | Welch | 83/37 |
| 6,382,066 | B1 | | 5/2002 | Maier et al. | |
| 6,544,105 | B1 | * | 4/2003 | Berne et al. | 83/500 |
| 6,662,072 | B1 | * | 12/2003 | Berne et al. | 83/364 |

FOREIGN PATENT DOCUMENTS

| | | | |
|---|---|---|---|
| DE | 100 23 210 | A1 | 11/2001 |
| FI | 68185 | | 4/1985 |
| GB | 2 093 189 | A | 8/1982 |
| WO | WO 2004/014619 | A1 | 8/2003 |

OTHER PUBLICATIONS

Search report issued in PCT/FI03/00594.

International Preliminary Examination Report issued in PCT/FI03/00594.

* cited by examiner

METHOD AND DEVICE FOR CALIBRATING THE POSITION OF BLADES OF A SLITTER-WINDER OF A PAPER OR BOARD MACHINE

CROSS REFERENCES TO RELATED APPLICATIONS

This application is a U.S. national stage application of International App. No. PCT/FI2003/000594, filed Aug. 7, 2003, the disclosure of which is incorporated by reference herein, and claims priority on Finnish Application No. 20021454, Filed Aug. 8, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In the slitter-winders of paper and board machines a web is cut in the cross-direction into several component webs, and a pair of blades comprising a top blade and a bottom blade is used in the cutting. The width of the component webs to be slit by the blades and thus the position of the slitting blades can vary to a great extent when different blade settings are used, depending on the set widths of the rolls to be produced. The slitting blades have to be positioned, in the lateral direction of the web, in the right slitting position corresponding to the desired roll widths. In order to produce component webs of the desired width the slitting blades of the slitter-winder are spaced apart as desired in the lateral direction of the paper or board web i.e. a change of settings is carried out.

FI patent 68185 discloses a method and a system for position change. This publication describes a method in a system used in the slitting of a paper web, in which, to observe the position of the slitting device, a measuring device is used which is in a position arrangement which comprises actuating members for controlling and performing the movement of the measuring device in the cross-direction of the web and which system comprises at least one limiter i.e. for limiting the operation of the measuring device along the distance between the extreme positions such that one extreme position serves as the datum position for the determination. An observing device in both directions of movement observes at least one member of the slitting device. The system comprises drive means for the actuating members and moving devices performing a corrective movement of a movable device or member. The position of the slitting blades has been determined during a standstill of the machine by means of this known arrangement, having the aim of minimizing the duration of the standstill.

It is known from prior art to measure the position of the blades used in slitting by means of a carriage-type arrangement, in which a sensor is placed in a moving carriage with which, by means of optic or magnetic measurement, the position of the blades has been established. These measurement methods are used in connection with the changing of settings.

In a prior art application based on magnetic measurement each blade carriage is equipped with a fixed permanent magnet, and the distance between the permanent magnet and the slitting blade is constant, and the position of the permanent magnet connected to the blade carriage is measured by means of a magnetic measuring device, thereby establishing the position of the blade. In connection with the changing of blade settings, information is also needed, in addition to the information on the position of the sharpening blades, on the new, replacing blades and, after the detachment and grinding of the blades, position information, since, after these steps, the distance between the slitting blade edge and the magnet of the blade carriage changes, which means that no exact information on the position of the blade is available based on the results from the measurement methods described above. Also, the slitting blade edge wears, which leads to inaccuracy when using the above-mentioned measurement methods. In the above-described situations, when prior art applications have been used, there has been a need to carry out so-called tuning runs in order to determine the position of the slitting blade edge.

SUMMARY OF THE INVENTION

It is an object of the invention to provide a solution for eliminating or at least minimizing the disadvantages described above. An object of the invention is to provide an easy-to-use and reliably operating method and device for calibrating the position of the blades of a slitter-winder.

The invention is based on a magnetostrictive sensor known as such, which sends out magnetic pulses on the basis of whose returning time the position of the blade is determined. Each top and bottom blade used in slitting comprises a permanent magnet on the basis of which information is continuously received on the position of the blades.

According to the invention at least one of the measurement points of the sensor is used, and magnetostrictive measurement is most appropriately used as the measurement method, some other equivalent multipoint measurement method also being suitable in this connection.

According to the invention, when the position of the blade carriage changes in relation to the position of the slitting edge, a measuring device i.e. a calibration tool is used, which is placed by the blade so that the positioning member of the calibration tool touches the slitting edge. The calibration tool is located on a guide and the position of the slitting edge is determined based on the measurement results of the magnet pairs or equivalent measuring members. When the blade concerned is known, it is possible to calculate, based on the distances, the exact position for the slitting edge. The device according to the invention is used on a slitter-winder when the blade is calibrated, e.g. when the bottom blade is worn or when changing the top blade, whereby information on the position of the slitting blade edge is received immediately, e.g. after a blade change, without separate tuning runs or the like.

The device according to the invention comprises, according to one of its advantageous applications, a manually operated measuring device equipped with a permanent magnet and its use in connection with a magnetostrictive sensor in the off-set calibration of a slitting blade edge. According to the invention the measuring device can also be positioned using other ways of measurement, e.g. based on optic procedure. Different types of data transfer procedures and wire and wireless, preferably digital, data transfer can be used in connection with the invention.

According to an advantageous application of the invention a manually operated measuring device is pressed against a blade guide and moved sideways to be in contact with the blade to be measured. Attachment to the guides allows the position of the magnet of the measuring device with respect to the sensor to be established, and it ensures that the direction of measurement is right. After this, the position of the magnet of the measuring device is read by means of a magnetostrictive sensor and the distance between the slitting blade edge and the fixed magnet of the blade carriage is calculated by software. According to the invention the calibrated blade positions can be brought accurately to the target i.e. to the desired slitting point without separate control measurements and movements or tuning runs and, in addition, the exact position of the blade is known at all times on the basis of feedback data.

According to a further advantageous feature of the invention the calibration can be automated, for example, so that when the measuring device finds a magnet, it performs the calibration, e.g., after the expiration of ten seconds, or, for example, a control button or an equivalent arrangement is used for performing the measurement.

The calibration according to the invention can be carried out easily without slide gauges or other equivalent precision tools. A further advantage of the invention is that, most appropriately, the calibration measurement procedure makes use of the same measurement method that is used in any case in determining the position of the blades.

In addition to the actual calibration tool no separate auxiliary devices or other accessories are needed in the invention and it is suited to be used for both the top and the bottom blades and for left- and right-handed blades. The device according to the invention is easy to use, thus reducing the chance of human mistakes, and the calibration arrangement according to the invention is easy to put into practice and does not require any special know-how.

A further advantage obtained by means of the invention is that, if the blade carriage is in an oblique position, which as such does not affect the mechanical operation of the slitting blade, this defect—irrectifiable as such only by improvement of measurement precision in other procedures—is also eliminated. Since the calibration tool according to the invention performs the measurement from the slitting point, better quality in the width of the component webs to be slit and thus in the delivery tolerance of the rolls can be obtained.

In the following, the invention will be described in greater detail with reference to the figures of the accompanying drawing.

DESCRIPTION OF THE PREFERRED EMBODIMENTS

Figure 1:
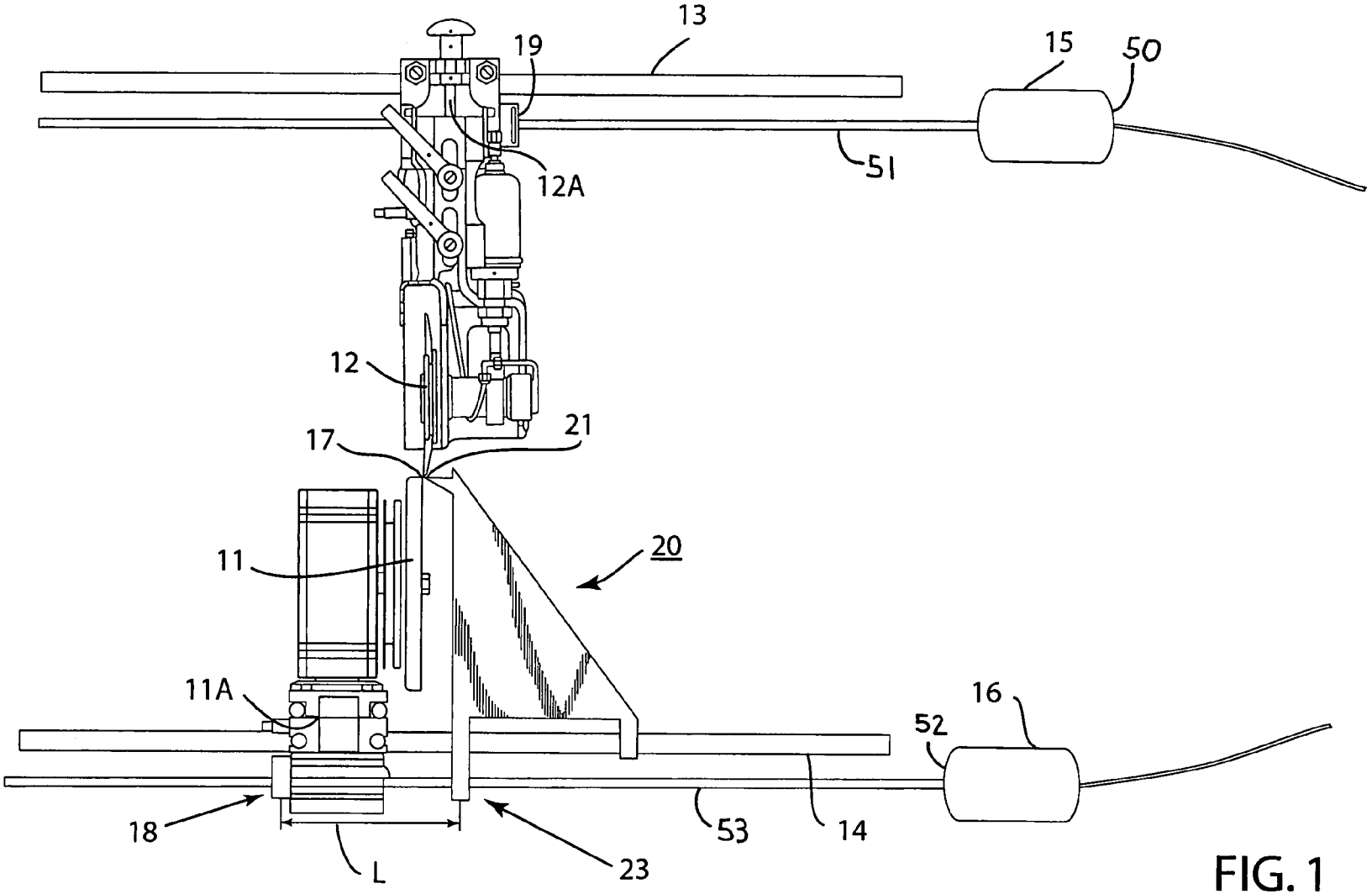
FIG. 1 shows an application of the invention as a schematic example.

FIG. 1 shows one of the top and bottom blade pairs used in slitting. A top blade 12 is attached to a blade carriage 12A, which is arranged to be movable along an upper guide 13, and a bottom blade 11 is attached to a blade carriage 11A, which is arranged to be movable along a lower guide 14. Each blade carriage 11A, 12A is equipped with a position magnet 18, 19. A magnetostrictive position sensor 15, 16 is arranged below each guide 13, 14, respectively, by means of which sensor the position of the respective position magnet 19, 18 is measured. The upper magnetostrictive position sensor has a first element 50 and a second element 51 which extends beneath the upper guide 13. The lower magnetostrictive position sensor 16 has a first element 52 and a second element 53 which extends beneath the lower guide 14.

The calibration tool 20 in the example shown in FIG. 1 is disposed on the lower guide 14. The calibration tool 20 has a protruding control edge 21. The calibration tool is arranged on the guide 14 so that the control edge 21 touches a slitting edge 17 of the bottom blade 11. A position magnet 23 is attached in connection with the calibration tool 20, and the magnet marking the position of the bottom blade 11 has the reference number 18, which means that the off-set distance L between the position magnet 23 of the calibration tool 20 and the position magnet 18 of the bottom blade 11 can be determined by means of magnetostrictive measurement.

When the calibration tool 20 is attached to the blade guide 14 and moved sideways so that the control edge 21 is in contact with the slitting edge 17 of the ground bottom blade 11, the precise position of the blade edge 17 is determined as follows. The position of the calibration tool magnet 23 is measured by the magnetostrictive sensor 16, as is the position of the permanent magnet 18 on the bottom blade carriage 11A. Software then computes the distance between the slitting blade edge (as determined by the position of the calibration tool control edge) and the permanent magnet 18 of the bottom blade 11. The distance between the bottom blade carriage permanent magnet 18 and the blade edge 17 is then known. The blade carriage can then be moved to position with the blade edge 17 in a known position.

Figure 2A:
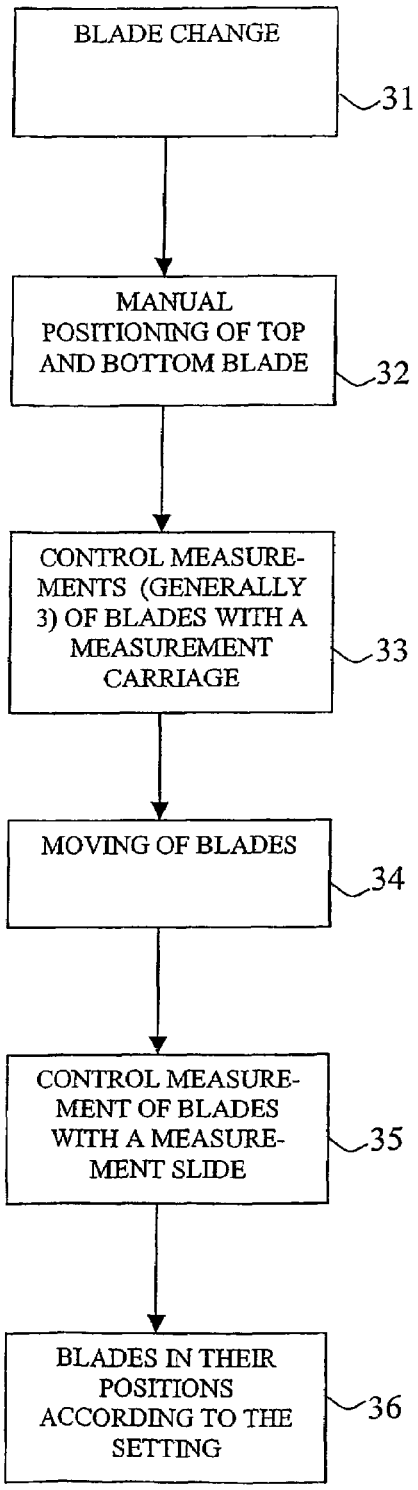
FIG. 2A PRIOR ART
FIG. 2A shows a schematic block diagram representation of a prior art blade change sequence.

FIG. 2A shows a prior art blade change sequence, according to which, after a blade change, block 31, manual positioning of a bottom and a top blade, block 32, has been carried out, whereafter, according to block 33, generally three control measurements of the blades have been performed by means of a measurement carriage. After this, the blades have been moved to their positions, as shown in block 34, and a control measurement of the blades has been carried out by means of the measurement carriage, block 35, whereafter, in the last stage, the blades are in their positions according to the setting, block 36. As illustrated by this series of steps the blade change sequence has consisted of several different stages.

Figure 2B:
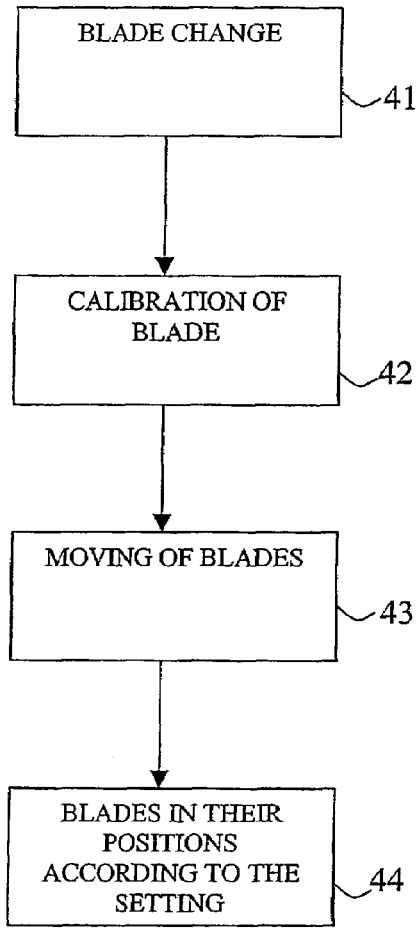
FIG. 2B shows a schematic block diagram representation of an application of the method according to the invention.

FIG. 2B shows a blade change sequence when using the method and device according to the invention in calibrating the position of the blades, whereby, after a blade change, block 41, the blade is calibrated according to the invention, block 42, whereafter the blades have been moved to their positions, block 43. After this, the blades are in their positions according to the setting, block 44. FIGS. 2A and 2B thus demonstrate that, by means of the calibration according to the invention, many stages can be omitted in connection with the measurements and positionings carried out in connection with blade change.

In the foregoing the invention has been described with reference only to some of its advantageous exemplifying embodiments, to the details of which the invention is, however, by no means intended to be narrowly confined.

The invention claimed is:

1. A method for calibrating the position of blades of a slitter-winder of a paper or board machine, wherein each blade is attached to a blade carriage disposed on a guide, comprising the steps of:

measuring the position of a blade carriage having a blade to be calibrated mounted thereto by a multipoint measurement method;

arranging a positioning member of a calibration tool to touch a slitting edge of the blade to be calibrated;

measuring the position of the calibration tool by a multipoint measurement method; and determining the position of the slitting edge of the blade to be calibrated with respect to the blade carriage having the blade to be calibrated, based on the measured position of the calibration tool.

2. The method of claim 1, wherein in measuring the position of the blade carriage having the blade to be calibrated and the position of the calibration tool the same multipoint measurement method is used.

3. The method of claim 1 wherein the position of the blade carriage having the blade to be calibrated is determined by measuring, by means of a sensor, the position of a first measuring member attached to the blade carriage of the blade to be calibrated, and that the position of the calibration tool is determined by measuring with the sensor, the position of a second measuring member attached to the calibration tool, whereby, on the basis of measurement results, the position of the slitting blade edge is determined.

4. The method of claim 1 wherein the multipoint measurement method is a magnetostrictive measurement method, in which the positions of a position magnet attached to the blade carriage of the blade to be calibrated and of a position magnet attached to the calibration tool are determined by means of a magnetostrictive sensor, the calibration tool being arranged to touch the slitting edge of the blade to be calibrated, whereby, on the basis of measurement results, the exact position of the slitting blade edge can be determined.

5. The method of claim 4 wherein the magnetostrictive measurement method is performed with a magnetostrictive measurement sensor having a first element and a second element positioned below the guide of the blade carriage having a blade to be calibrated, and wherein the positions of the position magnet attached to the blade carriage of the blade to be calibrated and of the position magnet attached to the calibration tool are determined with respect to the position sensor second element.

6. The method of claim 4 wherein, when calibration is carried out, the sensor measuring the position of the calibration tool automatically performs a measurement when it finds the position magnet of the calibration tool.

7. The method of claim 1 wherein, when the calibration tool is arranged in its position, the measurement steps are initiated by pressing a control button.

8. A device for calibrating the position of blades of a slitter-winder of a paper or board machine, the slitter-winder having pairs of blades comprising a top blade and a bottom blade, each blade being attached to a respective blade carriage which is movable along a guide, which device is disposed in connection with the slitter-winder of the paper or board machine, the device comprising:

a calibration tool arranged to be attached to the same guide on which the blade carriage of the blade to be calibrated is attached; and portions of the calibration tool which form an element for indicating the slitting edge of the blade; and apparatus for measuring the position of the calibration tool and the carriage of the blade to be calibrated; and apparatus for calculating the position of the slitting edge of the blade to be calibrated with respect to the blade carriage.

9. The device of claim 8, wherein the apparatus for measuring comprises a sensor arranged in connection with the slitter winder, and further comprising:

a measuring member attached to the blade carriage of the blade to be calibrated, the position of which measuring member can be determined by the sensor;

wherein the calibration tool element is positionable to touch the slitting edge of the blade; and portions of the calibration tool which define a position member for measuring the position of the calibration tool by the sensor.

10. The device of claim 8 wherein the apparatus for measuring comprises a magnetostrictive sensor arranged in connection with the slitter winder, and further comprising:

a position magnet attached to the blade carriage of the blade to be calibrated; and a position magnet attached to the calibration tool.

11. The device of claim 10 wherein the magnetostrictive position sensor has a first element and a second element which extends beneath the guide on which the blade carriage of the blade to be calibrated is attached, and wherein the positions of the position magnet mounted to the calibration tool and the magnet mounted to the blade carriage of the blade to be calibrated are determined with respect to the position sensor second element.

12. The device of claim 8 wherein the calibration tool is movable along the guide to which the blade carriage of the blade to be calibrated is mounted.

13. A method for changing and calibrating a blade in a slitter-winder of a paper or board machine having an upper and a lower blade, wherein each blade is attached to a blade carriage disposed on a guide, the method comprising the steps of:

changing a selected blade, the changed blade being mounted to a selected blade carriage which is disposed on a selected guide;

applying a calibration tool to the selected guide, the calibration tool having a positioning member which extends to engage an edge of the selected blade;

measuring the location of a first point on the calibration tool which is in a known location with respect to the positioning member;

calculating the position of the positioning member and thereby determining the position of the selected blade edge, based on the measurement of the location of the first point;

measuring the location of a second point on the selected carriage which is fixed with respect to the selected blade edge;

calculating the location of the blade edge with respect to the second point based on the determined position of the selected blade edge; and moving the carriage to a set position to thereby position the selected blade edge at a desired location.

14. The method of claim 13 wherein the step of applying the calibration tool to the selected guide comprises positioning the calibration tool on the selected guide such that a position magnet mounted to the calibration tool is detectable by a magnetostrictive position sensor, and wherein the step of measuring the location of the first point on the calibration tool comprises determining the position of the position magnet with a magnetostrictive position sensor.

15. The method of claim 13 wherein the step of measuring the location of a second point on the selected carriage comprises determining the location of a magnet mounted to the selected carriage with the magnetostrictive position sensor.

16. The method of claim 15 wherein the magnetostrictive position sensor has a second element which extends beneath the selected guide, and wherein the positions of the position magnet mounted to the calibration tool and the magnet mounted to the selected carriage are determined with respect to the position sensor second element.

* * * * *